United States Patent [19]

Slysh

[11] Patent Number: 4,921,565

[45] Date of Patent: May 1, 1990

[54] PARTS ORBITER FOR CHEM-MILLING VAT

[76] Inventor: Paul Slysh, 3047 Ducommum Ave., San Diego, Calif. 92122

[21] Appl. No.: 344,688

[22] Filed: Apr. 28, 1989

[51] Int. Cl.[5] ..... B44C 1/22; C23F 1/00

[52] U.S. Cl. ..... 156/345; 156/639

[58] Field of Search ..... 156/345, 639, 654, 659.1; 134/33, 120, 140, 149, 157, 159; 414/431

[56] References Cited

U.S. PATENT DOCUMENTS 4,137,118 1/1979 Brimm ..... 156/345

*Primary Examiner*—William A. Powell

*Attorney, Agent, or Firm*—Charles C. Logan, II

[57] ABSTRACT

An improved parts orbiter for use in a chem-milling vat. The orbiter has a major frame assembly that is self standing which is lowered into the chem-milling vat. A minor frame assembly is positioned within the major frame assembly and it is pivotally mounted thereto about a horizontal axis. A first motor is connected to a drive sprocket gear, a chain, and a driven sprocket gear for rotating the minor frame assembly about the horizontal axis. A planetary gear is mounted on a shaft extending upwardly from the bottom cross member of the minor frame assembly. Its teeth are in meshing engagement with a sun gear that is mounted on a shaft whose one end passes through one of the horizontal side members of the minor frame assembly and has its end also passing through one of the upright side members of the major frame assembly. A second drive motor is connected through a drive sprocket gear, a chain, and a driven gear which itself is also mounted on the same shaft that the sun gear is mounted on. The second motor allows the planetary gear to be rotated around a vertical axis at the same time that the minor frame assembly is rotating around its horizontal axis.

8 Claims, 2 Drawing Sheets

PARTS ORBITER FOR CHEM-MILLING VAT

BACKGROUND OF THE INVENTION

The present invention relates to the fabrication of metallic components, and more particularly to a novel parts orbiter for use in a chem-milling vat.

The orbiter will generally be described with reference to producing chemically milled external isogrid or waffle grid patterns on a circular or non circular symmetrical shell structure. Such integral titanium or Inconel structures are found in aircraft engine inlets, by pass ducts and augmenter cases. The orbiter, however, is not limited by the construction material, to any set of structural shapes or applications, to whether the structure is pocketed or not and, when it is pocketed, to any specific type or configuration of pocket or grid pattern.

An orbiter, as it applies to chem-milling processes, is typically used to control the movement or tumbling of a part or a collection of parts in an etchant bath in such a manner that, in effect, the part or parts receive uniform exposure to the etchant and therefore receive uniform chemical milling. This typically requires that all exposed (i.e. chemically milled) surfaces spend an effective equal amount of time in varying positions with respect to the gravitational vertical. The following paragraphs explain and identify the phenomena influencing the above preferred (ESIO) exposed-surface integrated orientation and the manner in which applicant's orbiter provides the unique, singular and universal means for optimizing the (ESIO) exposed-surface integrated orientation.

If an essentially flat pocket is inverted in a quiescent or agitated etchant bath such that the exposed surface faces downward along the gravitational vector, then the gasses or fumes generated by chemical milling will accumulate in the pocket and either inhibit or stop the chemical milling from preceeding in that pocket. The degree that the pocket is curved (in single or compound curvature) in conformance with the shell curvature and the pocket depth exceeds the local vertical pocket arc height, part (i.e. the center) of the pocket experiences dramatically different rates of metal removal than other parts (i.e. the edges) of the pocket. This condition, caused in part by the entrapment of fumes under the maskant overhangs, is particularly prevalent when the pocket is at or near a bottom dead center orientation.

Also during the periods the pockets being chemically milled have exposed surfaces in other than inverted positions the uniformity of the depth of cut, etch rates, ridging, dishing, etch factors along the pocket edges and channeling are dependent on the sum total of the times the pockets are exposed in these varying non inverted positions. As in the case of inverted pockets, these effects are also influenced by such factors as the the bath temperature thermal gradients in the etchant and part, acid and surfactant concentration levels, the degree of dissolved metal concentration in the etchant, and the heat sink created by the mass in the rib cross sections.

The knowledge of the afore mentioned and related facts in qualitative form and quantitative detail is determined from experiment or published data in the public domain is of importance, and invoked hereby reference, for implementation and utilization of applicant's novel orbiter.

The quality of chemical milling is essentially the net result of cumulative effects experienced in pockets during periods the pockets are inverted and non-inverted positions as outlined above. The means provided by applicant's orbiter for optimally controlling the part (ESIO) exposed-surface integrated orientation is the single most important factor in moderating and mitigating the outlined and related adverse phenomenological effects on chemical milling quality.

It should be noted that pockets can be formed by deliberate maskant scribing or the basic shape of the part being chemically milled. When a part in effect has no pockets then the inverted exposed surface position referred to above is a theoretical singular point and is non existant and the chemical milling anomalies which imply the existance of pockets are not operable. In such a case applicant's orbiter provides means for optimizing the (ESIO) exposed-surface integrated orientation based on the inherent part geometry, its internally or externally controlled heat sinks as well as the standard etchant formulation and control parameters.

Some patents that teach the processes for forming intricate metal structures using chem-milling are illustrated in U.S. Pat. No. 4,137,118 of Brimm and U.S. Pat. No. 3,940,891 of Slysh. The Brimm patent also discloses an early version of an orbiter.

It is an object of the invention to provide a novel parts orbiter for chem-milling that has dual drives that permit infinite orbiting ratio adjustments.

It is also an object of the invention to provide a novel orbiter for chem-milling that allows the orbiting parameters to be adjustable for longitudinal and circumferential etch factor and removal rate modifications.

It is an another object of the invention to provide a novel orbiter for chem-milling that allows taper removal to be accomplished following normal chemical milling.

It is an additional object of the invention to provide a novel orbiter for chem-milling that is economical to manufacture and market.

SUMMARY OF THE INVENTION

Applicant's novel orbiter consists of a programable and universally controlled system of right-angle to in-line sun and planetary gear drive. The part to be chemically milled is attached directly to the planetary gear. The rotation of the sun gear is controlled directly by a programmable NC (numerically controlled) actuator and the rotation of the planetary gear is controlled by the combined controlled movement of the sun gear as well as by programmable NC actuation of the frame on which the planetary gear is rotationally mounted. This system rotationally translates a part to be chemically milled through an etchant bath in such a manner that all externally and internally exposed surfaces of the part are angularly translated about two pre set axes in a systematic and prescribed manner. The angle between the axes of the sun and planetary gears can be preset to any angle between zero and ninety degrees. The axes can also either be coplanar or offset, in different planes, as in hypoid gears.

In all the possible gearing arrangements the gearing may range from involute to pinwheel types to provide a degree of smoothness of rotation that is consistent with the size of the part and the strength of the orbiter structure to withstand rotational angular accelerations.

In the case of a pinwheel or equivalent drive, the angle and offset between the sun and planetary gear axes are adjustable within the limits of the drive system.

This allows for the adjustment to be built into the planetary gear support frame. Alternatively, when involute gearing is used the gearing is replaced to accomodate the adjustments.

For purposes of this description, the part to be chemically milled is divided into elemental surface areas. The periods for which the different elemental exposed areas of the part are held in horizontal top-dead-center, horizontal bottom-dead-center, vertical exposure position and all intermediary exposure positions depend on: (a) the locations of the areas relative to the axes of the gears, (b) the instantaneous orbiting ratio which is a product of the relative rotational rates induced about each of the gear axes, and (c) the programmed absolute time and/or position dependent rotational rates about each of the gear axes. Applicant's orbiter provides means for initially setting or variably adjusting each of the perimeters for purposes of optimizing the chemical milling process.

DESCRIPTION OF THE PREFERRED EMBODIMENT

Figure 1:
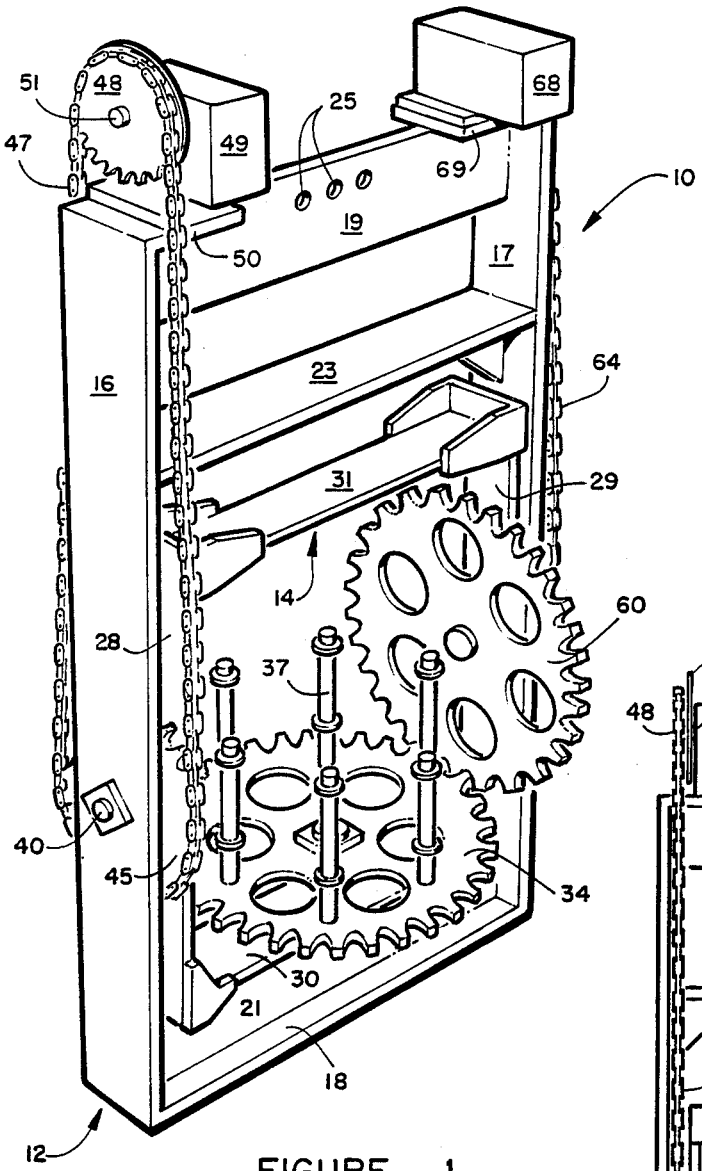
FIG. 1 is a front perspective of applicant's novel parts orbiter for a chem-milling vat.
Figure 2:
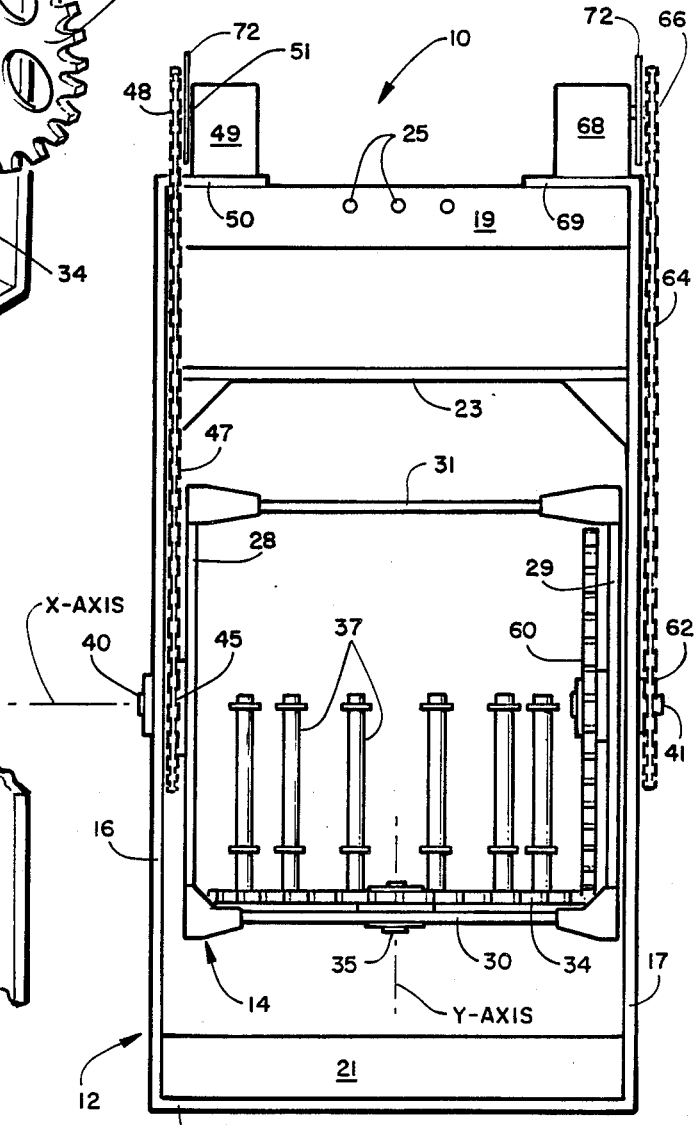
FIG. 2 is a front elevation view of the novel parts orbiter.

Applicant's novel orbiter has been designed to be used in a vat such as illustrated in U.S. Pat. No. 4,137,118 to Brimm. Also applicant's orbiter would be transported by an overhead hoist to cyclically or intermittently raise or lower the orbiter and the work piece during the course of the etching step. This technique is used to form tapered or other non-uniform configurations on the work piece. Applicant's orbiter will now be described by referring to FIGS. 1–3 of the drawing.

Applicant's orbiter is generally designated numeral 10. It has a major frame assembly 12 and a minor frame assembly 14.

Major frame assembly 12 has a rectangular configuration and it is formed from laterally spaced side members 16 and 17, bottom cross member 18, and top cross member 19. Brace member 21 and brace member 23 add structural integrity to the major frame assembly 12. A plurality of apertures 25 are formed in top cross member 19 and they may be utilized for lifting the major frame assembly by a cable attached to an overhead hoist.

Minor frame assembly 14 is formed from a pair of laterally spaced side members 28 and 29, a bottom cross member 30, and a top cross member 31. A planetary gear 34 is mounted on a shaft 35 whose axis coincides with the vertically oriented y-axis. A plurality of parts mounting rods 37 are vertically oriented with their bottom ends secured to the top surface of planetary gear 34.

Minor frame assembly 14 is pivotally mounted within major frame assembly 12 by the respective shafts 40 and 41 that are oriented along horizontally extending x-axis. A driven sprocket gear 45 is also mounted on shaft 40. Closed loop chain 47 passes around driven sprocket gear 45 and also drive sprocket gear 48. Motor 49 is mounted on support platform 50 and it has a shaft 51 that transmits its rotational power to drive sprocket 48.

Sun gear 60 is mounted on one end of shaft 41 and a driven sprocket gear 62 is mounted on its other end. A chain 63 passes around driven sprocket gear 62 and drive sprocket gear 66. Motor 68 is mounted on support platform 69 and it has a drive shaft 70 that transmits its rotational motion to drive gear 66. A baffle 72 prevents the motor from being splashed by the etchant flying off the chain. The level of the acid bath would be below the height of the motors.

Figure 3:
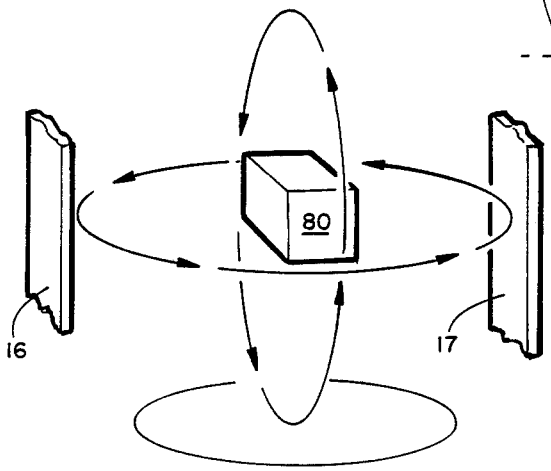
FIG. 3 is a schematic illustration showing how a part being chem-milled may be revolved aout the vertical and horizontal axes.

In FIG. 3 a work piece is illustrated and it schematically shows how the work piece may be rotated simultaneously around a vertical axis and a horizontal axis to insure uniform etching of the work piece.

Figure 4:
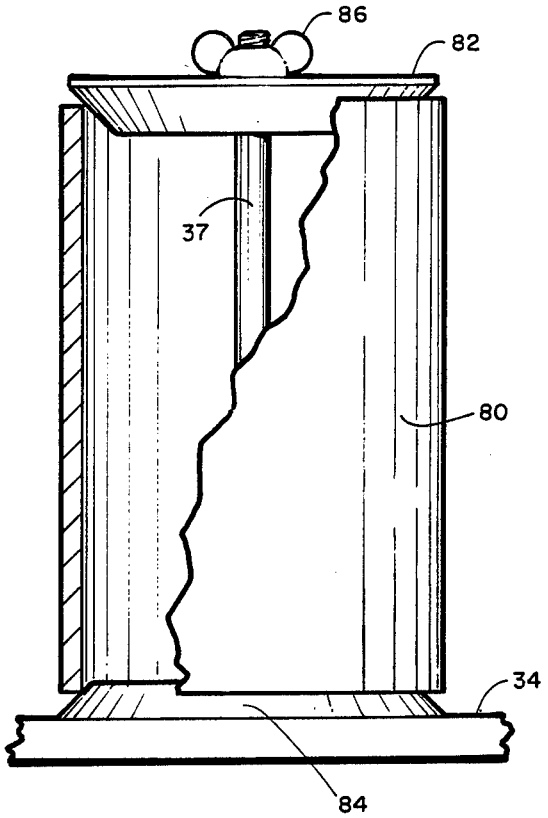
FIG. 4 is a front elevation view of the planetary gear showing a cylindrical shell workpiece secured to one of the ports mounting rods.
Figure 6:
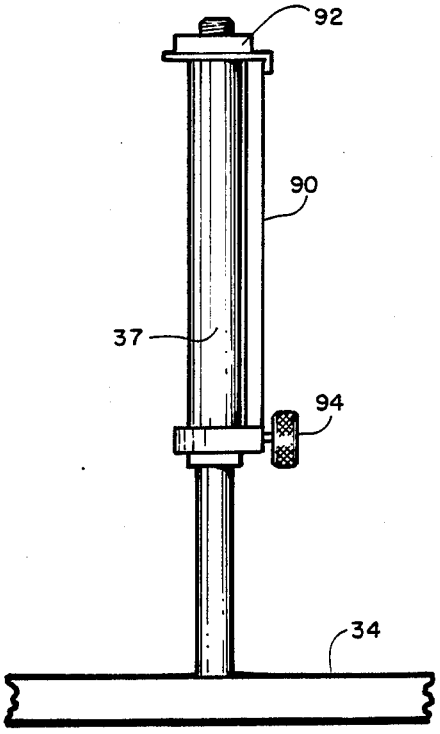
FIG. 6 is a side elevation view showing the sheet workpiece secured to the parts mounting rod.
Figure 5:
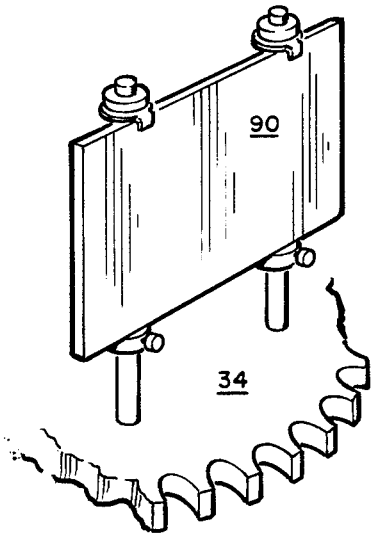
FIG. 5 is a partial front perspective view showing a sheet workpiece secured to two of the ports mounting rods.

The manner in which different shaped workpieces are secured to the parts mounting rods 37 that are detachably secured to the top surface of planetary gear 34 is illustrated in FIGS. 4–6. A cylindrical shell workpiece 80 is secured by plugs 82 and 84 that are mounted on parts mounting rod 37 and locked in position by wing-nut 86. A workpiece 90 in the form of a sheet is detachably secured by top clamps 92 and bottom clamps 94.

The following describes some of the ways applicant's novel orbiter is used to achieve unique chemical milling results, to optimize quality, and to minimize manufacturing costs associated with chemical milling.

With the longitudinal axis of a body of revolution fixed in any one adjustable orientation the rotation rate about the longitudinal axis is independently controllable. If the longitudinal axis is fixed in a horizontal position and the rotation about the longitudinal axis is at a constant or near constant rate between 180 degree dwell positions then the body of revolution will receive less chemical milling at two diametric locations. By proper control of the rotational periodicity the chemical milling can be gradually varied from thin to thick sections in 90 degree rotational increments about the longitudinal axis. This feature is usuable in many structural applications, such as bypass ducts and augmenter cases used in fighter aircraft.

Due to normal chemical milling operations there is a tendency in shell of revolution structure for the ends of the shell near the bolted flanges to chemically to mill at a slower rate than elsewhere due to the heat sink afforded by the flanges and the orbiter mounting plugs. The resulting end of part taper is typically removed by a separate operation involving the selected and controlled immersion of each end of the part in the etchant. Applicant's orbiter allows for the ends of the part to be immersed in the etchant with the longitudinal axis of the part at a controlled fixed angle (depending on the taper) with respect to the surface of the etchant and the corner of the part extending into the etchant an amount equal to the slant length of the taper. The part is now rotated about its longitudinal axis at a constant rate to remove the taper. This approach provides superior control over the conventional taper removal process.

Applicant's orbiter also permits a shell structure to be tumbled about a cross longitudinal axis while no rotation takes place about the longitudinal axis. This feature can be used with proper programming to achieve the same results described previously above.

Experimental and published data provides means for exploring the versatility of applicant's novel orbiter to program part tumbling to optimize chemical milling results.

What is claimed is:

1. An improved parts orbiter for a chem-milling vat comprising:

a major frame assembly having a pair of laterally spaced upright side members, a bottom cross member and a top cross member;

a minor frame assembly having a pair of laterally spaced side members each having a top end and a bottom end, a top cross member connecting said respective top ends and a bottom cross member connecting said respective bottom ends;

a planetary gear journaled on a shaft extending upwardly from the bottom cross member of said minor frame assembly;

means for rotating said minor frame assembly about a horizontal axis that passes through the respective upright side members of said major frame assembly, said minor frame assembly being located within said major frame assembly; and means for rotating said planetary gear on its shaft.

2. An improved parts orbiter for a chem-milling vat as recited in claim 1 further comprising a plurality of parts mounting rods having their bottom ends secured to the top surface of said planetary gear.

3. An improved parts orbiter for a chem-milling vat as recited in claim 1 wherein said major frame assembly has a rectangular configuration.

4. An improved parts orbiter for a chem-milling vat as recited in claim 1 wherein the top cross member of said major frame assembly has at least one aperture therein for detachably receiving the attachment end of an overhead hoist cable.

5. An improved parts orbiter for a chem-milling vat as recited in claim 1 wherein said means for rotating said minor frame assembly comprises a first and a second shaft, said first shaft passing through one of the respective side members of said major frame assembly and said minor frame assembly, a driven sprocket gear is mounted on said first shaft.

6. An improved parts orbiter for a chem-milling vat as recited in claim 5 wherein said means for rotating said minor frame assembly further comprises a first drive motor mounted on the top cross member of said major frame assembly, a drive sprocket gear is mounted on a shaft extending from said first drive motor, a closed loop chain passes around said drive sprocket gear and said driven sprocket gear for rotating said minor frame assembly about a horizontal axis.

7. An improved parts orbiter for a chem-milling vat as recited in claim 5 wherein said means for rotating said planetary gear on its shaft comprises a sun gear mounted on said second shaft, a driven sprocket gear is also mounted on said second shaft.

8. An improved parts orbiter for a chem-milling vat as recited in claim 7 wherein said means for rotating said planetary gear on its shaft comprises a second drive motor mounted on the top cross member of said major frame assembly, a drive sprocket gear is mounted on a shaft extending from said second drive motor, a closed loop chain passes around said drive sprocket gear and said driven sprocket gear for rotating said planetary gear about a vertical axes.

* * * * *